US010264840B2

(12) United States Patent
Teetzel et al.

(10) Patent No.: US 10,264,840 B2
(45) **Date of Patent: *Apr. 23, 2019**

(54) HEADGEAR SHROUD ASSEMBLY

(71) Applicant: Wilcox Industries Corp., Newington, NH (US)

(72) Inventors: James W. Teetzel, Portsmouth, NH (US); Justin D. Harris, Chelmsford, MA (US)

(73) Assignee: Wilcox Industries Corp., Newington, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,523

(22) Filed: Sep. 19, 2017

(65) Prior Publication Data

US 2019/0014846 A1 Jan. 17, 2019

Related U.S. Application Data

(63) Continuation of application No. 14/483,471, filed on Sep. 11, 2014, now Pat. No. 9,775,395.

(60) Provisional application No. 61/878,901, filed on Sep. 17, 2013.

(51) Int. Cl.
*A42B 3/04* (2006.01)

(52) U.S. Cl.
CPC ..... *A42B 3/042* (2013.01); *A42B 3/04* (2013.01)

(58) Field of Classification Search
CPC ..... A42B 3/04; A42B 3/228; A42B 3/08
See application file for complete search history.

(56) References Cited

U.S. PATENT DOCUMENTS

| | | | | |
|---|---|---|---|---|
| 5,914,816 | A | 6/1999 | Soto et al. | |
| 6,662,370 | B1 | 12/2003 | Buchanan, Jr. et al. | |
| 7,219,370 | B1 | 5/2007 | Teetzel et al. | |
| 8,867,128 | B2 | 10/2014 | Rivkin et al. | |
| 9,414,633 | B2 | 8/2016 | Giroux Bernier et al. | |
| 9,775,395 | B2 * | 10/2017 | Teetzel | A42B 3/042 |

FOREIGN PATENT DOCUMENTS

WO WO2015/001428 A2 1/2015

* cited by examiner

*Primary Examiner* — Tajash D Patel
(74) *Attorney, Agent, or Firm* — McLane Middleton, Professional Association

(57) ABSTRACT

In one aspect, a shroud assembly for headgear includes a frame having a shape that matches a contour of the headgear. An insert is formed of metal or metal alloy and is attached to a front side of the frame. The insert is configured for removable attachment to a mounting assembly. The frame includes first and second spaced flexible walls disposed on the front side of the frame on opposite sides of the insert. The first and second flexible walls are spaced a sufficient distance apart to provide an interference fit between the mounting assembly and the first and second flexible walls. In another embodiment, the shroud assembly further includes a friction pad disposed on a rear surface of the frame for increasing friction between the shroud assembly and the headgear. In another aspect, a method for attaching a mounting assembly to headgear is provided.

27 Claims, 10 Drawing Sheets

HEADGEAR SHROUD ASSEMBLY

CROSS-REFERENCE TO RELATED APPLICATIONS

This application is a continuation of U.S. application Ser. No. 14/483,471 filed Sep. 11, 2014, now U.S. Pat. No. 9,775,395, which, in turn, claims the benefit of U.S. provisional application No. 61/878,901 filed Sep. 17, 2013. Each of the aforementioned applications is incorporated by reference in its entirety.

BACKGROUND

The present invention relates to an improved shroud for mounting an accessory device to headgear. The shroud described herein may advantageously be used in connection with mounting assemblies for attaching night vision devices and will be described herein primarily by way of reference thereto. However, it will be recognized that the shroud herein may be used with all manner of helmet or other headgear mounted accessories devices.

Night vision devices are used by military personnel, law enforcement personnel, and so forth when conducting military or tactical operations at night or under other low light conditions. Commonly, a mounting system is employed on the front of the user's headgear, such as a field helmet, to provide hands free support of the night vision device in front of the eyes of the user. Such mounting systems typically provide vertical, lateral, fore-and-aft, and tilt adjustment mechanisms for alignment of an attached night vision device with the eye or in the case of a binocular device eyes of the user. Mounting systems are known which allow the user to pivot the night vision device up to a stowed position out of the user's line of sight when not in use without removing the night vision device from the helmet.

Although mounting assemblies are known that allow the user to pivot the night vision device out of the way when the night vision device is not in use, it is often desirable to completely remove the night vision system and the mounting system from the headgear, e.g., during the daytime, in order to reduce helmet weight and strain on the user's neck, when entanglement hazards exist, etc. Commonly, night vision mounting systems are made removably attachable to a helmet through the use of a mounting bracket or shroud, as described, for example, in commonly owned U.S. Pat. No. 7,219,370. Such shrouds attach to the headgear with threaded fasteners using one or more holes drilled through the helmet. Standardized hole patterns have been developed, such as the Army-compatible single hole pattern and the MARSOC/WARCOM three-hole pattern. The use of standard hole patterns allow helmets to be pre-drilled to accept any shroud compatible with that hole pattern.

Typically, such helmet shrouds are machined using aluminum or other metal and include a receptacle for removable attachment of the mounting assembly. It has been found, however, that the manufacturing tolerances of the prior art shrouds are such that there is generally some clearance between the receptacle of the shroud and the interfacing portion of the mounting system, which results in a small amount of movement or play between the shroud and the mounting assembly. If has also been found that the process of repeated removal and attachment of the night vision mount creates wear, resulting in greater clearance and play between the shroud and the mounting assembly.

The present disclosure contemplates a new and improved shroud assembly that overcomes the above-referenced problems and others.

SUMMARY

In one aspect, a shroud assembly for headgear includes a frame which may be formed of a polymer material and having a shape that matches a contour of the headgear. An insert is formed of a metal or metal alloy and is attached to a front side of the frame. The insert is configured for removable attachment to a mounting assembly. The frame includes first and second spaced flexible walls disposed on the front side of the frame on opposite sides of the insert. The first and second flexible walls are spaced a distance apart so as to provide an interference fit between the mounting assembly and the first and second flexible walls.

In another embodiment, the shroud assembly further includes a friction pad disposed on a rear surface of the frame for increasing friction between the shroud assembly and the headgear.

In another aspect, a method for attaching a mounting assembly to headgear includes providing a shroud assembly by attaching an insert formed of a metal or metal alloy attached to a front side of a frame. The insert is configured for removable attachment to the mounting assembly. In certain embodiments, the frame is formed of a polymer material and has a shape that matches a contour of the headgear. The insert is attached to the frame between first and second spaced flexible walls disposed on the front side of the frame on opposite sides of the insert. The first and second flexible walls are spaced a distance apart to provide an interference fit between the mounting assembly and the first and second flexible walls. The mounting assembly is removably attached to the insert.

One advantage of the present development resides in its ability to prevent relative movement or play between the mounting assembly and the shroud.

Another advantage of the present development is found in the weight reduction that is capable of being achieved by making a portion of the shroud assembly from a polymer material.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
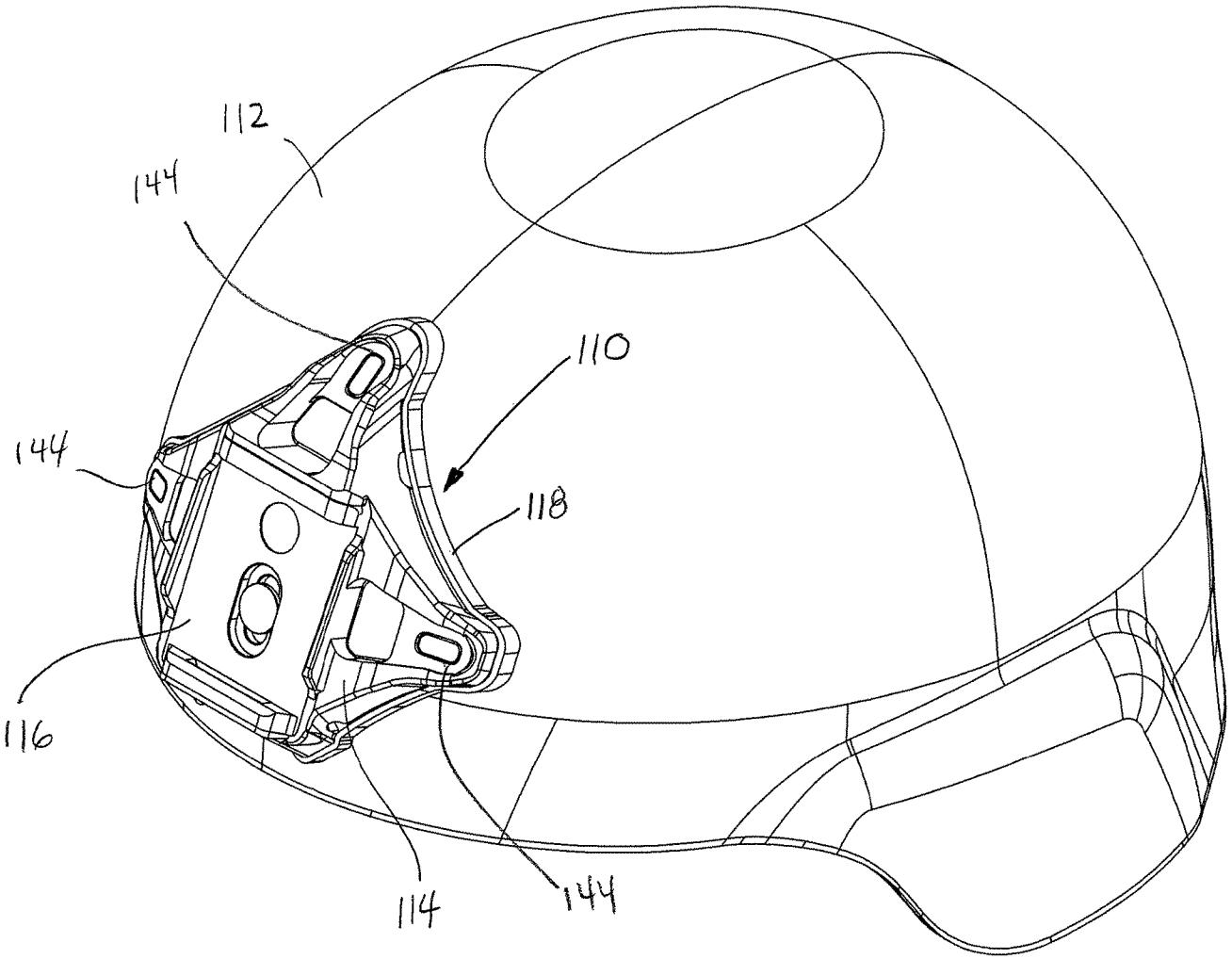
FIG. 1 illustrates a shroud according to a first exemplary embodiment, attached to a helmet.
Figure 2:
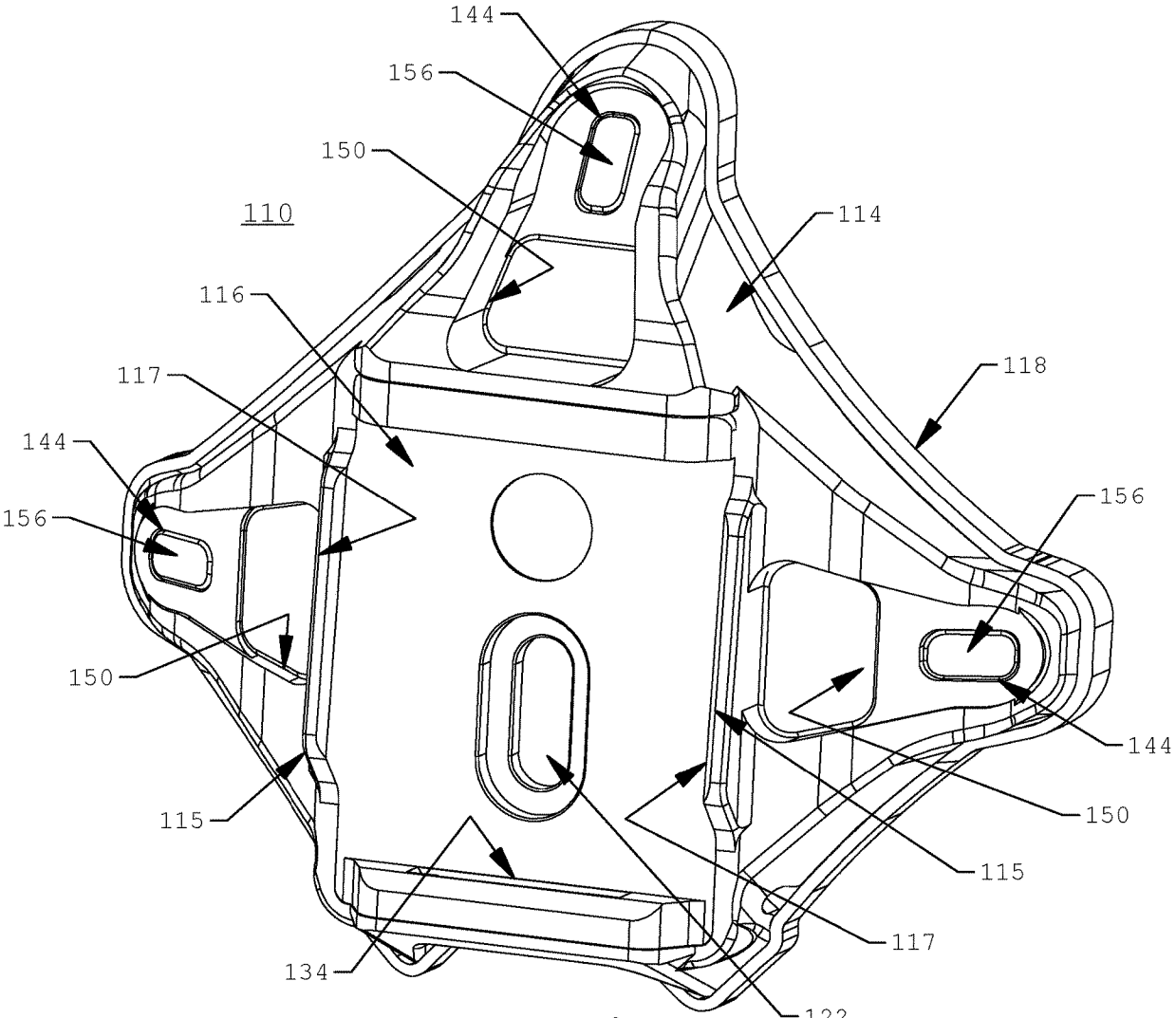
FIG. 2 is an enlarged isometric view of the shroud appearing in FIG. 1.
Figure 3:
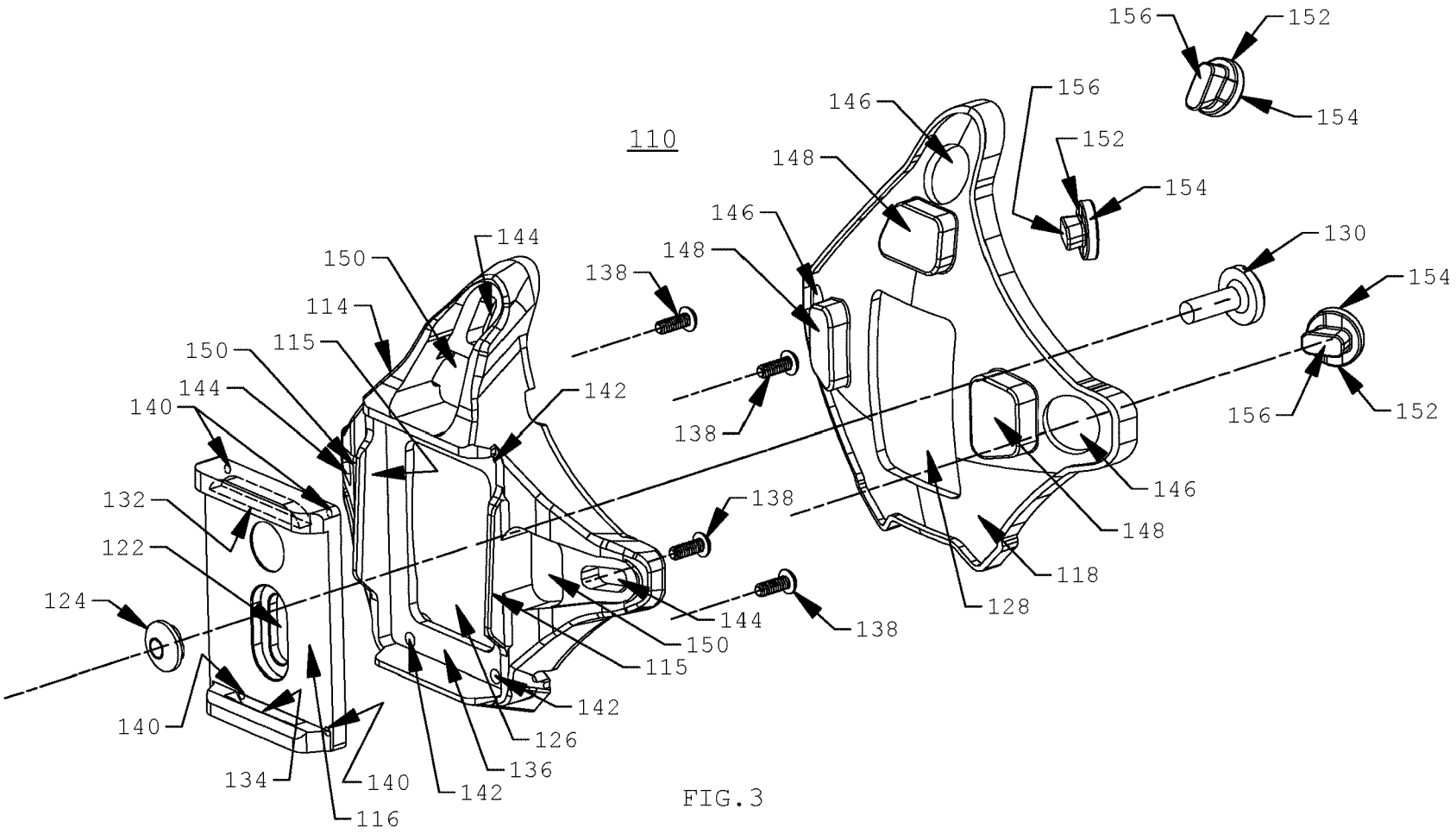
FIG. 3 is an exploded view of the shroud appearing in FIG. 1.
Figure 4:
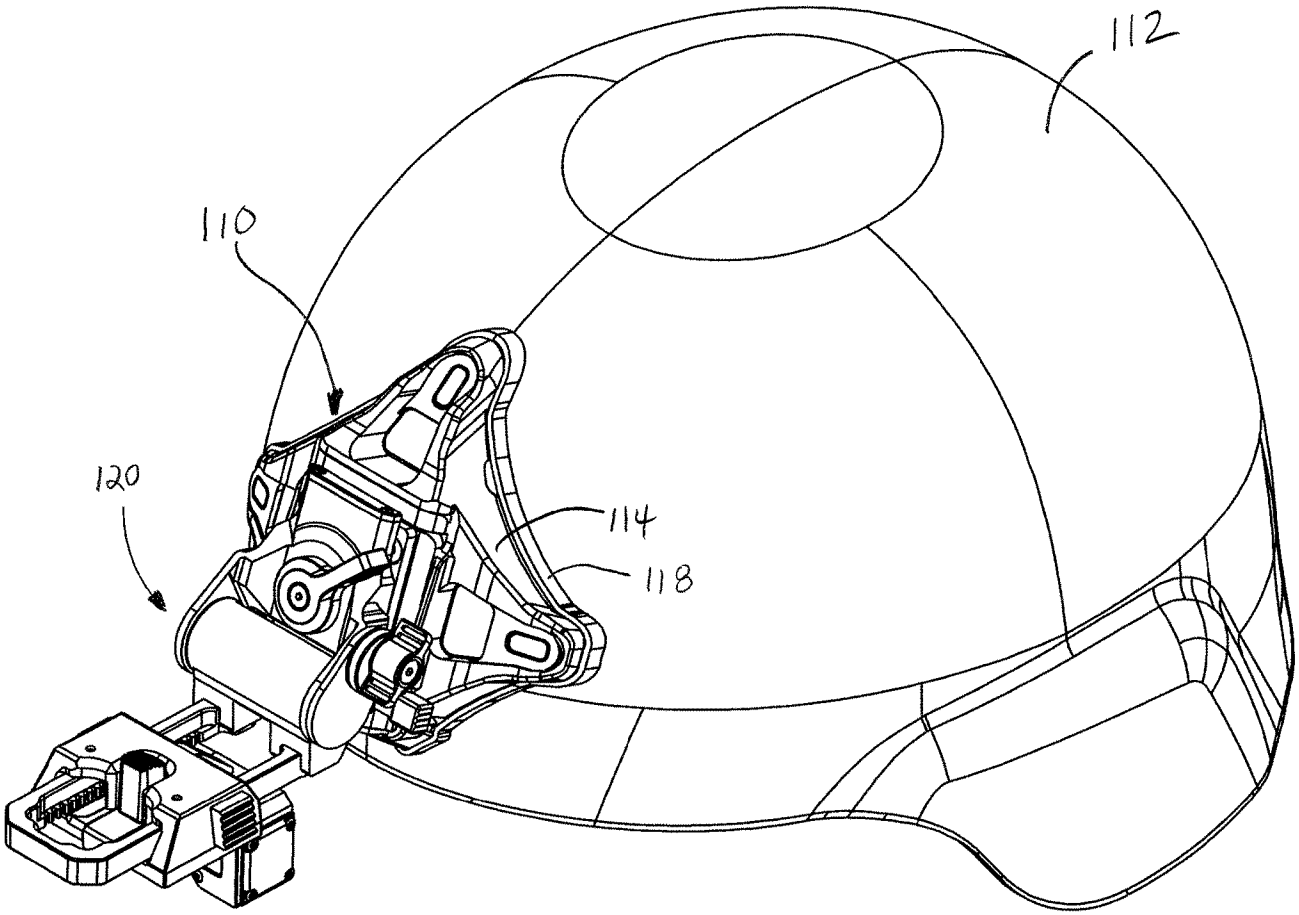
FIG. 4 illustrates the shroud embodiment of FIG. 1 with a night vision mount removably attached.
Figure 5:
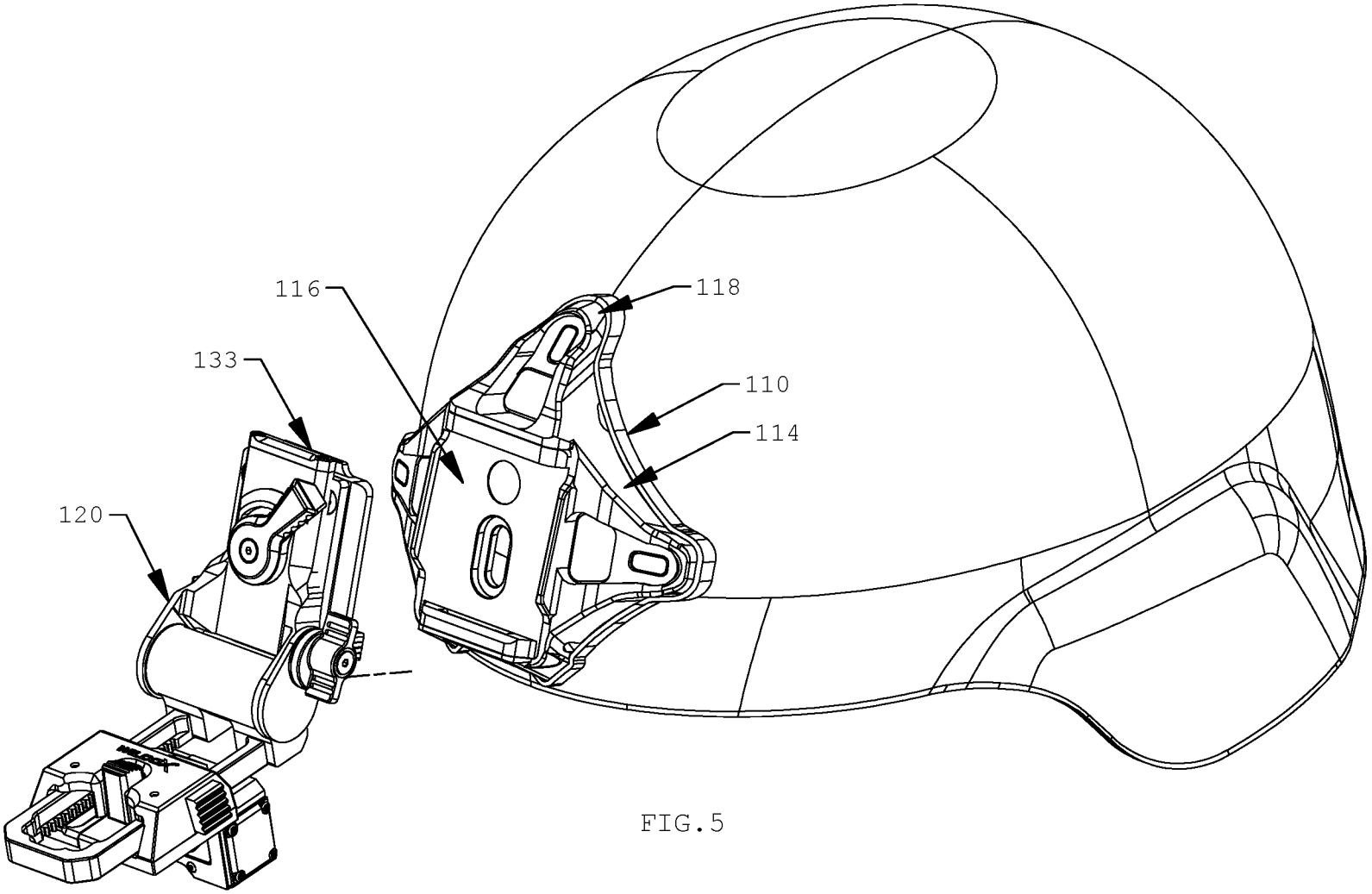
FIG. 5 illustrates the shroud embodiment of FIG. 1 with the night vision mount removed.
Figure 6:
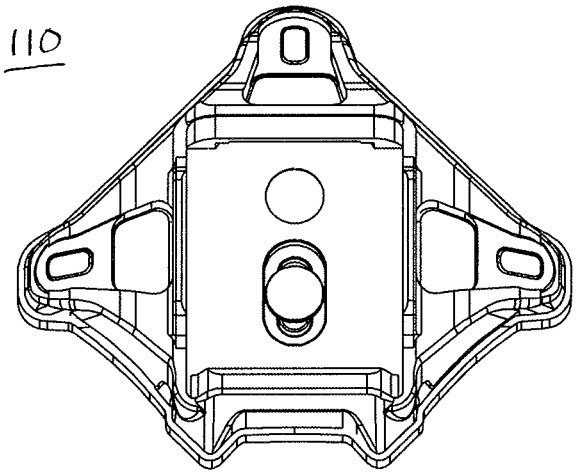
FIG. 6 is a front elevational view of the shroud embodiment of FIG. 1.
Figure 7:
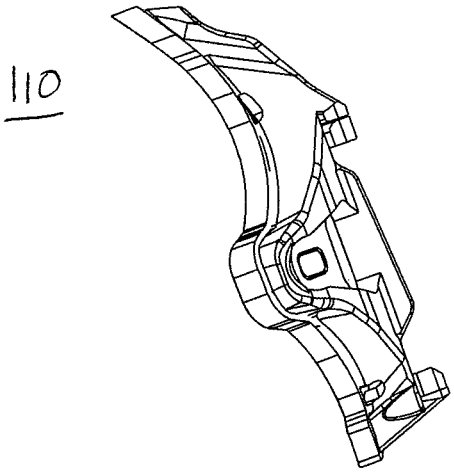
FIG. 7 is a left side elevational view of the shroud embodiment of FIG. 1, the right side view being a mirror image thereof.
Figure 8:
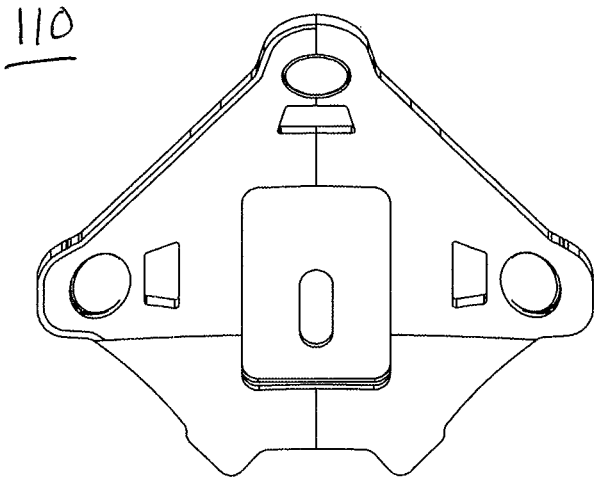
FIG. 8 is a rear elevational view of the shroud embodiment of FIG. 1.
Figure 9:
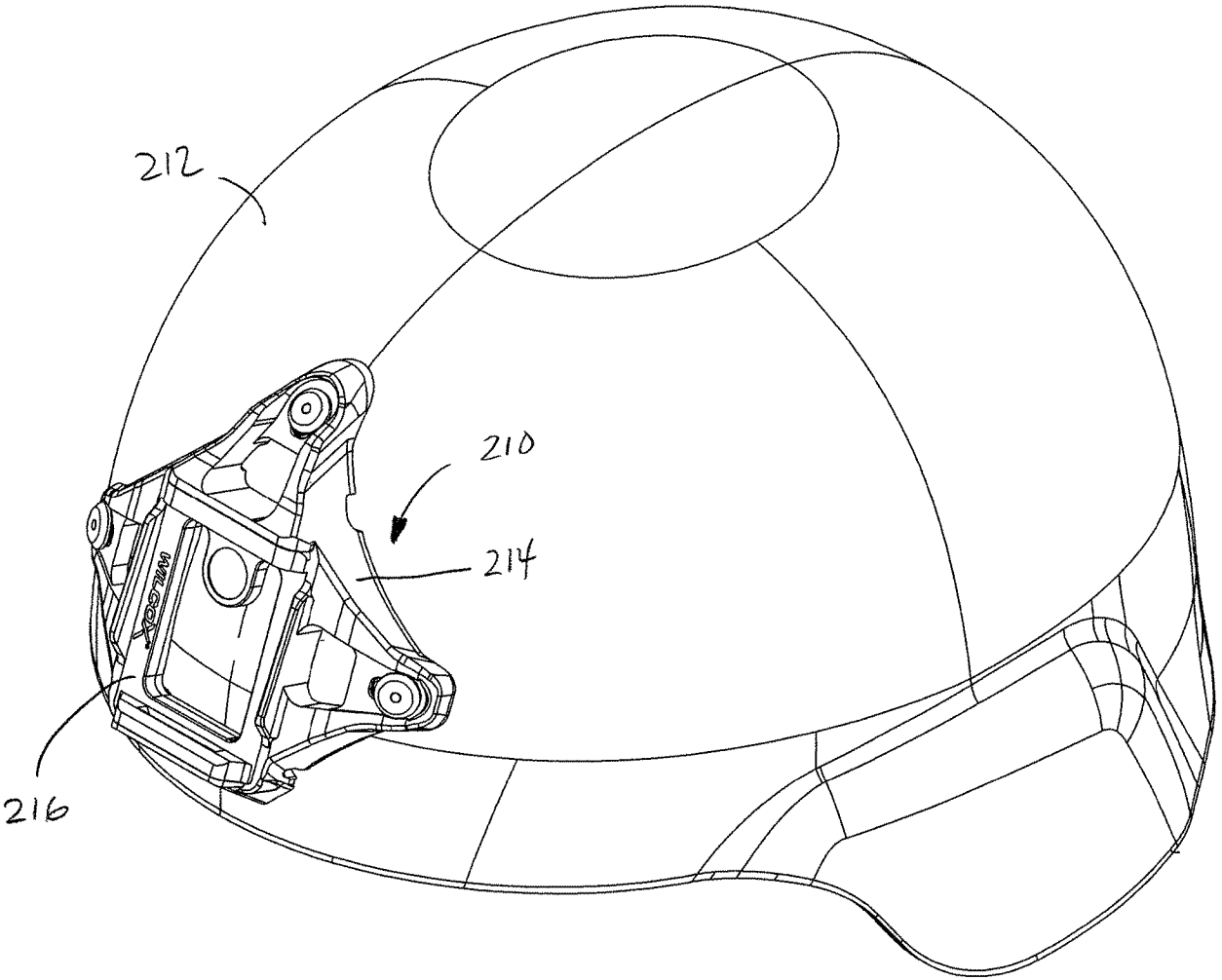
FIG. 9 illustrates a shroud according to a second exemplary embodiment, attached to a helmet.
Figure 10:
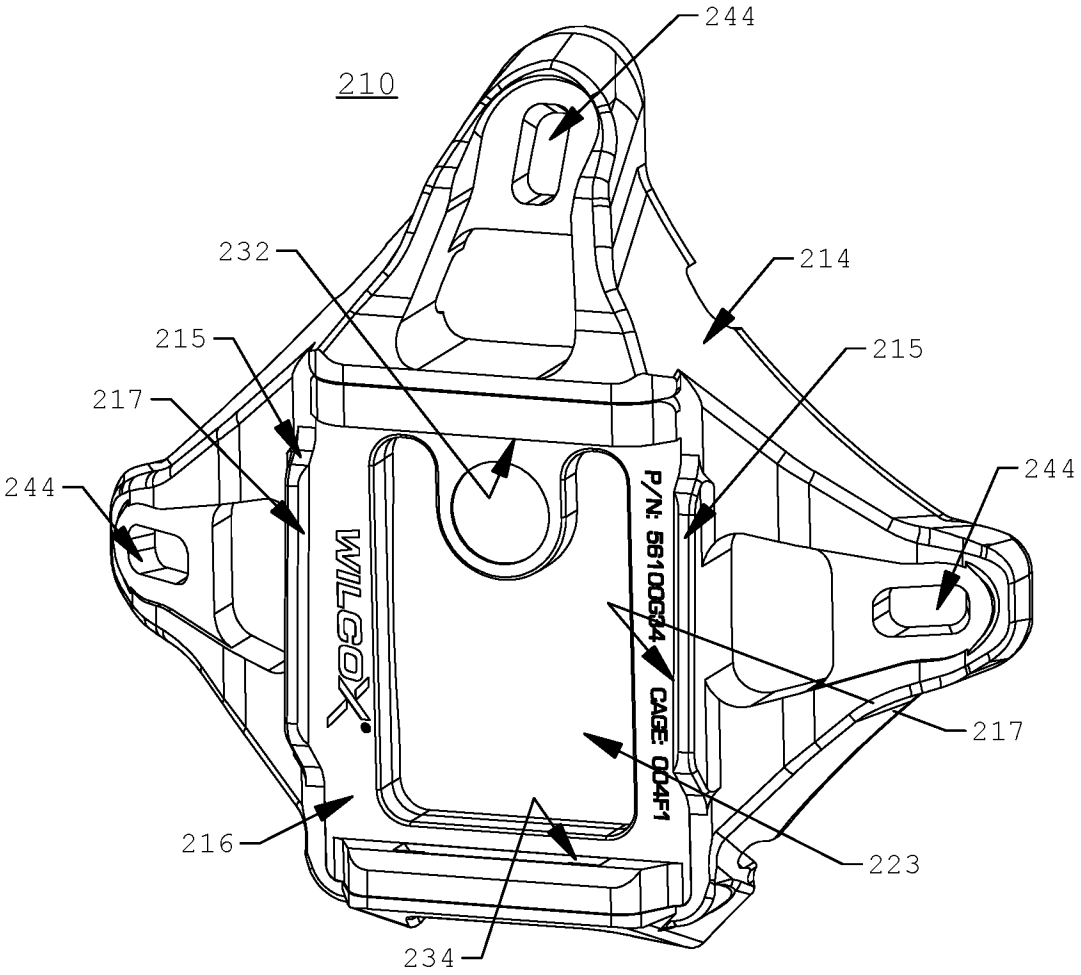
FIG. 10 is an enlarged isometric view of the shroud appearing in FIG. 9.

Referring now to the drawings, FIGS. 1-8 illustrate a first embodiment shroud assembly 110 for attachment to the front of a helmet 112. For the sake of brevity, the present shroud assembly will be described herein primarily by way of reference to use with night vision systems. However, it will be recognized that the present shroud assembly is also amenable for use with all manner of monocular and binocular devices, including optical viewing devices, thermal cameras, head up displays, virtual reality goggles, or other electronic or optoelectronic imaging devices.

The shroud assembly 110 includes a frame, e.g., a polymer frame 114, a metal or metal alloy insert 116, and a natural or synthetic elastomeric pad 118. The shroud assembly 110 is primarily intended for use in connection with a helmet 112 having a single mounting hole, such as the standard U.S. Army one-hole mounting pattern, and will be described primarily by way of reference thereto. It will be recognized, however, that the shroud assembly 110 could likewise be used with or without the elastomeric backing pad 118 with a helmet having holes drilled in a three hole mounting pattern, such as the standard MARSOC/WARCOM three-hole pattern, in the same manner as detailed below in connection with the shroud assembly 210.

The shroud assembly 110 provides an interface for the removable attachment of a night vision mounting system 120. The mounting system may be, for example, a night vision mounting system in the L4 product line available from Wilcox Industries Corp. of Newington, N.H. It will be recognized that the present shroud assembly can be adapted for use with all manner of night vision mounting systems by providing an insert 116 which has retention features complimentary with a desired night vision mounting system. In certain embodiments, the polymer frame may be provided with a plurality of interchangeable metal inserts to provide a modular system capable of being used with multiple mounting systems.

The frame 114 and the friction pad 118 have a generally concave rearward surface which is shaped to generally conform to the shape of the helmet 112. The elastomeric pad 118 may be formed of natural or synthetic rubber or other elastomer. The pad 118 increases the friction between the shroud assembly 110 and the helmet 112 and is particularly advantageous for use with a helmet 112 having a one hole pattern to prevent rotation about fasteners 124, 130 which secure the shroud assembly 110 to the helmet 112.

The insert 116 is preferably formed by machining although cast or molded inserts 116 are also contemplated. The insert 116 is preferably formed of aluminum or aluminum alloy. In the illustrated preferred embodiment, the insert 116 includes an opening 122 for receiving a threaded fastener 124. The opening 122 may be elongated in the vertical direction to provide vertical adjustability when mounting the assembly 110, e.g., to accommodate differences between the drilled hole placement on the helmet, accommodate edge trim on the brim of the helmet, and so forth.

The threaded fastener passes through the hole 122, a large central opening 126 in the polymer frame 114, a large central opening 128 in the elastomeric pad 118, and a hole (not shown) in the helmet 112. The fastener 124 is secured to a complementary threaded fastener 130 on the inside of the helmet 112.

The insert 116 includes features, such as upper and lower recesses 132, 134, respectively, for removably engaging latch members 133 formed on the mounting system 120. The insert 116 is received within a like sized cavity 136 on the composite member 114. One or more fasteners, such as threaded fasteners 138 secure the insert 116 within the cavity 136 via openings 140 in the insert 116 and openings 142 in the frame 114. Other fasteners, such as other types of mechanical fasteners or adhesives are also contemplated.

In certain embodiments, the frame 114 may be formed of an injection moldable plastic, such as a thermoplastic resin, although thermosetting polymers are also contemplated. In preferred embodiments, the frame 114 is formed of a fiber reinforced polymer matrix composite material, although other materials are contemplated. Reinforcing fibers for polymer matrix composite materials are generally known. Exemplary fibers include carbonaceous fibers (e.g., carbon or graphite fibers), glass fibers, and other filamentary materials. In an especially preferred embodiment, the frame 114 is formed of a 30% glass filled polyimide composite material.

A pair of flexible walls or blades 115 extends from the face of the polymer frame 114 immediately adjacent the cavity 136 on opposite lateral sides thereof. Because the blades 115 are formed of a polymer material, they can flex and can therefore be spaced apart a distance that provides a snug, interference fit between the blades 115 and the sides of an attached mounting system 120. In this manner, side-to-side movement between the mounting system 120 and the shroud assembly 110 can be eliminated. This is in contrast to prior art metal shrouds which must be toleranced to provide a clearance fit between the shroud and the mounting system, allowing undesirable side-to-side movement between the shroud and the helmet mount. In addition, the use of a polymer frame 114 provides a reduction of the weight of the shroud assembly 110 as compared to prior art metal shrouds.

In the depicted preferred embodiment, the blades 115 include a tapered or angled surface 117 on the interior facing side thereof to facilitate insertion of the mounting system 120 and outward flexing of the blades 115.

The depicted preferred embodiment illustrates an exemplary shroud assembly adapted for use with a mounting assembly that has latches that move or provide tension in the vertical direction, such that the blades 115 are disposed on opposite lateral sides of an attached mounting assembly. Other orientations of the blades, however, are also contemplated. For example, in the case of a mounting assembly having latch members that move and provide tensioning in a horizontal direction, the flexible blades could be oriented horizontally above and below the mounting assembly interfacing portion to eliminate up and down movement.

The frame 114 is of a generally triangular construction and includes three openings 144 at the corners. The friction pad 118 is shaped to receive the frame 114 on the outward facing surface of the friction pad 118 in a stacked or nested arrangement. The pad 118 includes three openings 146 at the corners aligned with the openings 144 at the corners of the frame 114. The pad 118 further includes three bosses or protrusions 148, which are disposed intermediate the central opening 128 and the openings 146. When the frame 114 and the friction pad 118 are stacked in the assembled, nested configuration, the bosses 148 extend through aligned openings 150 in the frame 114, to interlock the frame 114 and the pad 118 together. The frame 114 and pad 118 are further secured via three plugs 152 at the corners of the unit 110. Each plug 152 includes a base 154 which is received in one of the openings 146 in the pad 118. Each plug 152 further includes a protrusion 156 that extends through a corresponding one of the openings 144 in the frame 114.

Figure 11:
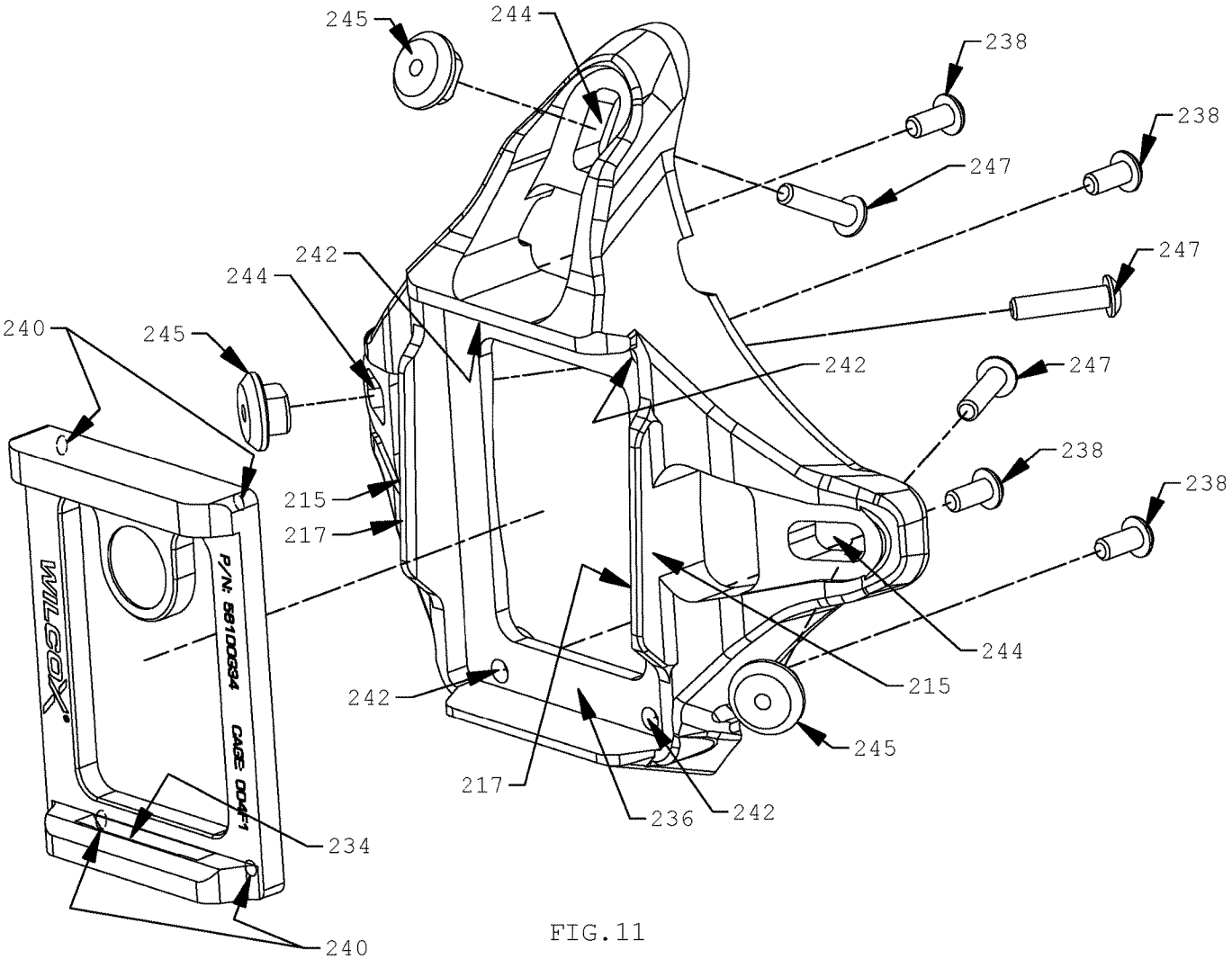
FIG. 11 is an exploded view of the shroud appearing in FIG. 9.
Figure 12:
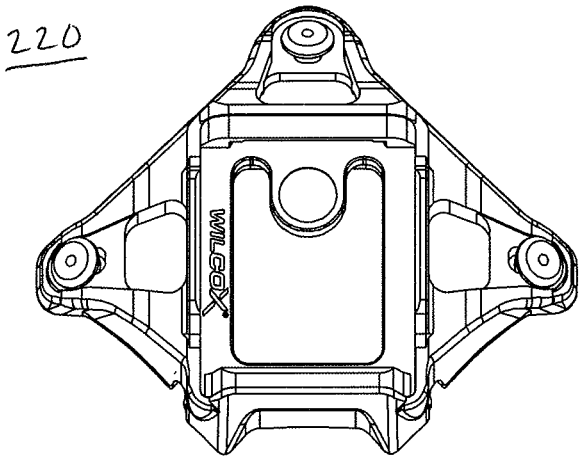
FIG. 12 is a front elevational view of the shroud embodiment of FIG. 9.
Figure 13:
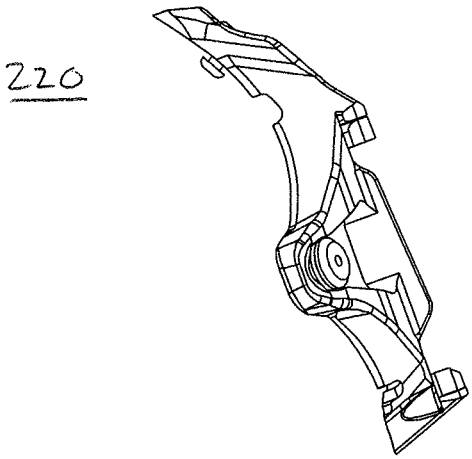
FIG. 13 is a left side elevational view of the shroud embodiment of FIG. 9, the right side view being a mirror image thereof.
Figure 14:
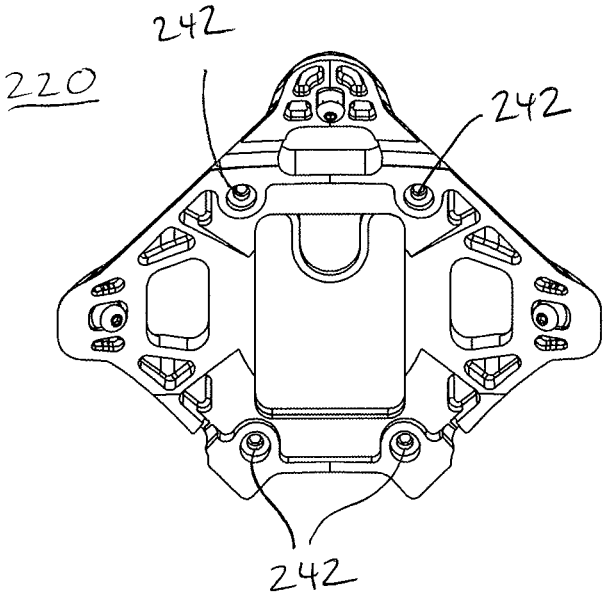
FIG. 14 is a rear elevational view of the shroud embodiment of FIG. 9.

In alternative embodiments, the plugs 152 can be omitted, as well as the central helmet fasteners 124, 130 and the unit 110 can be secured to a helmet having a three-hole pattern. The helmet drill/hole pattern may advantageously be the standard MARSOC/WARCOM three-hole pattern. It will be recognized that the unit 110 could also be attached to a helmet using both the central hole via the fasteners 124, 130 as well as three threaded fasteners (see e.g., fasteners 245, 247 appearing in FIG. 11) using the openings 144; however, in general, it is preferable to use only the one hole pattern or the three hole pattern, since unnecessary holes drilled into the helmet can compromise the ballistic integrity of the helmet.

Referring now to FIGS. 9-14, a second embodiment shroud assembly 210 for attachment to the front of a helmet 212 is illustrated. The shroud assembly 210 is similar to the embodiment 110 described above, however, the friction pad is omitted.

The shroud assembly 210 includes a polymer frame 214 and a metal or metal alloy insert 216. Because the should assembly 210 is intended for use with a three hole pattern, the insert 216 need not include the central fastening hole 122. The insert 216 may be formed by machining aluminum or an aluminum alloy. In the illustrated preferred embodiment, an enlarged central opening 223 is provided in the insert 216 to reduce the weight of the assembly, thereby reducing overall weight on the user's neck. However, the insert 216 otherwise interfaces with the mounting assembly in the manner as described above.

The mounting features of the insert 216 may be modified depending on the particular helmet mounting system to be employed. A modular system may also be provided wherein multiple metal inserts 216 are interchangeable to provide a system capable of being used with multiple mounting systems.

The insert 216 includes features, such as upper and lower recesses 232, 234, respectively, for removably engaging complementary latch members 133 (see FIG. 5) on the mounting system. The insert 216 is received within a like sized cavity 236 formed on the composite member 214. One or more fasteners, such as threaded fasteners 238 secure the insert 216 within the cavity 236 via openings 240 in the insert 216 and openings 242 in the frame 214. Other fasteners such other mechanical fasteners or adhesives are also contemplated.

The polymer frame 214 may be formed of an injection moldable plastic, and may be formed of the same materials as described above by way of reference to the frame 114 (see FIGS. 1-8)

A pair of flexible walls or blades 215 extends from the face of the polymer frame 214 immediately adjacent the cavity 236 on opposite lateral sides thereof. Because the blades 215 can flex, the blades can be spaced apart a distance that provides a snug, interference fit between the blades 215 and the sides of the mounting system 120 (see FIGS. 4 and 5). In this manner, side-to-side movement between the mounting system and the shroud assembly 210 can be eliminated. In the depicted preferred embodiment, the blades 215 include an angled or tapered surface 217 on the interior facing side thereof to facilitate insertion of the mounting system 120 and outward flexing of the blades 215. In reducing the present development to practice, it has been found that the present shroud continues to provide an interference fit between the shroud assembly and the mounting system even after insertion and removal of the mounting system more than 5,000 times. Again, vertically oriented blades are illustrated in the depicted embodiment, although other blade orientations are also contemplated.

The frame 214 is of a generally triangular construction and includes three openings 244 at the corners. Threaded fasteners 245 pass through the openings 244 and engage complementary threaded fasteners 247 passing through the helmet 212 to secure the shroud assembly to the helmet. The helmet drill/hole pattern may advantageously be the standard MARSOC/WARCOM three-hole pattern.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A shroud assembly for headgear, comprising:

a frame having a shape that matches a contour of the headgear;

an insert formed of a metal or metal alloy attached to a front side of the frame, the insert configured for removable attachment to a mounting assembly; and the frame including first and second spaced flexible walls disposed on the front side of the frame on opposite sides of the insert, said first and second flexible walls spaced a sufficient distance apart to provide an interference fit between the mounting assembly and the first and second flexible walls.

2. The shroud assembly of claim 1, wherein the first and second walls extend vertically on opposite lateral sides of the insert.

3. The shroud assembly of claim 1, wherein the first and second walls are configured to be displaced outward when the mounting assembly is removably attached to the insert.

4. The shroud assembly of claim 1, wherein each of the first and second walls have a tapered inward facing surface to facilitate insertion of the mounting system.

5. The shroud assembly of claim 1, further comprising:

said insert defining one or more receptacles configured to removably mate with a latch member of the mounting assembly.

6. The shroud assembly of claim 1, wherein the insert is formed of a material selected from the group consisting of a metal, metal alloy, and a polymer material.

7. The shroud assembly of claim 1, wherein the frame is formed of an injection moldable thermoplastic resin.

8. The shroud assembly of claim 1, wherein the frame is formed of a fiber reinforced polymer matrix composite material.

9. The shroud assembly of claim 8, wherein the frame is formed of a glass fiber reinforced polyimide matrix composite material.

10. The shroud assembly of claim 1, further comprising:
at least one opening in the frame configured to receive a mechanical fastener for attaching the shroud assembly to the headgear.

11. The shroud assembly of claim 1, further comprising:
first, second, and third openings in the frame, each of the first, second, and third openings configured to receive a mechanical fastener for attaching the shroud assembly to the headgear.

12. The shroud assembly of claim 11, wherein the first, second, and third openings are positioned in accordance with a promulgated standard for headgear drill hole patterns.

13. The shroud assembly of claim 12, wherein the promulgated standard is the MARSOC/WARCOM three-hole pattern.

14. The shroud assembly of claim 1, further comprising:
a friction pad disposed on a rear surface of the frame for increasing friction between the shroud assembly and the headgear.

15. The shroud assembly of claim 14, further comprising a first opening in the insert, a second opening in the frame, and a third opening in the friction pad, wherein the first, second, and third openings are aligned with an opening in the headgear for receiving a mechanical fastener attaching the shroud assembly to the headgear.

16. The shroud assembly of claim 15, wherein the position of the first opening corresponds to a military standard headgear single drill hole pattern.

17. The shroud assembly of claim 14, further comprising:
at least one boss protruding from the friction pad and extending through a complementary opening in the frame.

18. The shroud assembly of claim 14, further comprising:
fourth, fifth, and sixth openings in the frame;
seventh, eight, and ninth openings in the friction pad, the seventh, eight, and ninth openings aligned with the fourth, fifth, and sixth openings, respectively; and
a removable plug received in each of the seventh, eight, and ninth openings.

19. The shroud assembly of claim 18, wherein each plug has a protrusion extending into a respective one of the fourth, fifth, and sixth openings in the frame.

20. The shroud assembly of claim 18, wherein the fourth, fifth, and sixth openings in the frame are positioned in accordance with a standard headgear drill hole pattern.

21. The shroud assembly of claim 1, further comprising the mounting assembly.

22. The shroud assembly of claim 21, wherein the mounting assembly is a night vision device mounting assembly.

23. A method for attaching a mounting assembly to headgear, comprising:
providing a shroud assembly by attaching an insert formed of a metal or metal alloy attached to a front side of a frame, the insert configured for removable attachment to the mounting assembly, wherein the frame has a shape that matches a contour of the headgear, and wherein the insert is attached to the frame between first and second spaced flexible walls disposed on the front side of the frame on opposite sides of the insert, said first and second flexible walls spaced a sufficient distance apart to provide an interference fit between the mounting assembly and the first and second flexible walls; and
removably attaching the mounting assembly to the insert.

24. The method of claim 23, wherein the first and second walls extend vertically on opposite lateral sides of the insert.

25. The method of claim 23, wherein the shroud assembly further includes a friction pad disposed on a rear surface of the frame for increasing friction between the shroud assembly and the headgear.

26. The method of claim 23, further comprising:
removably attaching a night vision device to the mounting assembly.

27. The method of claim 23, wherein the frame is formed of a material selected from the group consisting of a metal, metal alloy, and a polymer material.

* * * * *